US008822864B2

(12) United States Patent
Borg et al.

(10) Patent No.: US 8,822,864 B2
(45) Date of Patent: Sep. 2, 2014

(54) SWITCHING APPARATUS

(71) Applicants: Tomas Borg, Ludvika (SE); Daniel Johansson, Grangesberg (SE)

(72) Inventors: Tomas Borg, Ludvika (SE); Daniel Johansson, Grangesberg (SE)

(73) Assignee: ABB Technology AG (CH)

( * ) Notice: Subject to any disclaimer, the term of this patent is extended or adjusted under 35 U.S.C. 154(b) by 0 days.

(21) Appl. No.: 13/974,593

(22) Filed: Aug. 23, 2013

(65) Prior Publication Data

US 2014/0008193 A1 Jan. 9, 2014

Related U.S. Application Data

(63) Continuation of application No. PCT/EP2012/052837, filed on Feb. 20, 2012.

(30) Foreign Application Priority Data

Feb. 23, 2011 (EP) ..... 11155589

(51) Int. Cl.
*H01H 15/24* (2006.01)
*H01H 3/50* (2006.01)
*H01H 9/20* (2006.01)

(52) U.S. Cl.
CPC .. *H01H 9/20* (2013.01); *H01H 3/50* (2013.01)
USPC ..... 200/538

(58) Field of Classification Search
USPC ..... 200/538, 325, 537, 539–542, 324, 323, 200/434, 243; 218/117, 1, 34; 337/114–115
See application file for complete search history.

(56) References Cited

U.S. PATENT DOCUMENTS

| | | | | |
|---|---|---|---|---|
| 2,800,547 | A * | 7/1957 | Johnson | 200/434 |
| 3,076,063 | A * | 1/1963 | Prace et al. | 200/1 TK |
| 3,873,791 | A | 3/1975 | Hurtle | |
| 4,154,996 | A | 5/1979 | Arnold | |
| 4,594,489 | A | 6/1986 | Gengenbach et al. | |
| 4,649,244 | A * | 3/1987 | Baginski et al. | 200/501 |

(Continued)

FOREIGN PATENT DOCUMENTS

| | | | |
|---|---|---|---|
| DE | 2056943 | A1 | 10/1971 |
| DE | 291192 | A5 | 6/1991 |

(Continued)

OTHER PUBLICATIONS

European Search Report Application No. EP 11 15 5589 Completed: Jul. 19, 2011; Mailing Date: Jul. 25, 2011 6 pages.

(Continued)

*Primary Examiner* — Edwin A. Leon
(74) *Attorney, Agent, or Firm* — St. Onge Steward Johnston & Reens LLC

(57) ABSTRACT

A switching apparatus for closing and/or opening an electric circuit. It has an actuating unit and a bistable mechanism. The actuating unit is linearly movable between a first end position in which the switching apparatus is in a closed state and a second end position in which the switching apparatus is in an open state. The linear movement defines an axis. The bistable mechanism is arranged to ensure that the actuating unit is held in either of the end positions. The bistable mechanism includes a cam means mechanically connected to the actuating unit and at least one cam follower. The invention also relates to a use of the invented apparatus.

12 Claims, 2 Drawing Sheets

(56) References Cited

U.S. PATENT DOCUMENTS

| | | | |
|---|---|---|---|
| 4,712,079 | A | 12/1987 | Marquardt |
| 6,538,347 | B1 | 3/2003 | Baranowski et al. |
| 2006/0061442 | A1 | 3/2006 | Brooks |

FOREIGN PATENT DOCUMENTS

| | | | |
|---|---|---|---|
| EP | 0519343 | A1 | 12/1992 |
| WO | 03096502 | A1 | 11/2003 |
| WO | 2006005817 | A1 | 1/2006 |
| WO | 2010026048 | A1 | 3/2010 |

OTHER PUBLICATIONS

International Search Report and Written Opinion of the International Searching Authority Application No. PCT/EP2012/052837 Completed: May 11, 2012; Mailing Date: May 22, 2012 9 pages.

* cited by examiner

SWITCHING APPARATUS

FIELD OF THE INVENTION

The present invention relates to a switching apparatus for closing and/or opening an electric circuit and including an actuating unit and a bistable mechanism, the actuating unit being linearly movable between a first end position in which the switching apparatus is in a closed state and a second end position in which the switching apparatus is in an open state, which linear movement defines an axis, the bistable mechanism being arranged to ensure that the actuating unit is held in either of the end positions.

Terms like "radial", "axial" and "circumferential" in the text of the present application refer to the defined axis.

BACKGROUND OF THE INVENTION

The switching apparatus might be a closer for quick closing an electric circuit, in particular of the medium or high voltage level. Such a switching apparatus normally has two contacts movable to and from each other. Usually the movement is linear. The relative movement can either be achieved in that one of the contact parts is movable and the other stationary or in that both contact parts are movable, and each movable contact part is provided with an actuator unit.

Upon a triggering signal a driving means activates the actuating unit to close or break the current.

It is important that the movable contact part is held in its position with great stability, whether it is the open or closed position. This is achieved by the bistable mechanism. According to prior art the bistable mechanism is a toggle device. Examples of this are disclosed in WO 03/096502 and U.S. Pat. No. 6,538,347.

The toggle device used according to prior art consists of a number of rods connected to the actuating unit, which often is shaped as a tube. Each rod is connected to a piston urged by a compression spring radially towards the tube. In the two end positions the rods are inclined with respect to the radial direction with the inclination in different directions for the two end position. When the driving means moves the tube from one end position to the other, the connecting rods have to pass a middle position, in which the rods are radial and the springs are compressed at the maximum. Actuation of the tube, i.e. the actuating unit, from one end position to the other thus has the effect that the rod moves from one inclined position to the other via a radial middle position. Each spring thereby will be gradually compressed from the substantially uncompressed state at the end position until the rod reaches its middle position. Thereafter the spring is gradually released when the rod moves from the middle position to the other end position. This means that a force for compressing the springs has to be overcome for moving the actuating unit from either end position. Thereby the end positions become stable.

Although the known bistable mechanism normally functions satisfactory it has some drawbacks. The mechanism is complicated, expensive and also time consuming to assemble. The stroke for the actuating tube is maximized, and if a larger stroke is desired, the stroke length also of the spring pistons has to be increased for geometrical reasons for a given maximum inclination of the toggle rod. The complete mechanical housing thereby needs to be larger in diameter. This could be a problem because the insulator housing of a switching apparatus might be quite large as it is today, and a still larger insulator might be needed for a larger stroke.

SUMMARY OF THE INVENTION

One object of the present invention is to overcome the problems entailing the conventional design of the bistable mechanism.

According to the invention this object is achieved in that a switching apparatus of the initially specified kind includes the specific features that the bistable mechanism includes a cam means mechanically connected to the actuating unit and at least one cam follower.

The invented bistable mechanism consists of less parts than the known device and is much easier and faster to assemble. Further the use of a cam allows a greater freedom to optimize the performance of the switching apparatus simply by shaping the profile of the cam accordingly. Another benefit is that the diameter of the housing can be much smaller since the means for urging each cam follower against the cam requires less radial space than the springs in the device according to prior art, which have to be dimensioned to allow the rods to move from the inclined position to the radial position. This is of particular interest for a switching device with a large stroke length. The use of a cam device as the bistable mechanism also has the advantage that the characteristic of the actuation movement can be freely tailored to be adapted to different needs for various applications simply by shaping the cam profile accordingly, whereas a toggle device has more limited flexibility in this respect.

According to an embodiment of the invention, the number of cam followers is one or two.

Using only two cam followers represents a particularly simple design with low weight and balanced forces. Using only one cam follower results in still fewer moving parts, and the device thereby is further simplified in this respect. A drawback in that case, however, is that the forces from the bistable mechanism are not outbalanced. If only one cam follower is employed it is therefore advantageous to arrange such that a counterforce acts on the side diametrically opposite to the cam follower.

According to an embodiment, each cam follower is arranged to be movable in a direction perpendicular to the axis.

Thereby a symmetrical force pattern is achieved, and the stabilizing forces at the end positions will be equal. The perpendicularly directed movement also leads to a simple design and reliable function.

According to an embodiment, each cam follower is arranged to be movable in a radial direction with respect to the axis.

This embodiment optimizes the cooperation between the cam and the cam followers and further simplifies the design.

According to an embodiment, there are at least two cam followers, and the cam followers are distributed evenly in the circumferential direction.

Thereby the forces exerted by the cam followers on the actuating unit is radially balanced, which leads to a simple construction with less requirements for bearings or similar guiding elements. With two cam followers, these are thus located radially opposite each other, and with three cam followers they are arranged at an angle of 120° to each other, etc.

According to an embodiment, there are at least two cam followers, and the cam followers contact the cam means in the same radial plane.

Thereby any bending forces from the cam followers on the actuating unit are eliminated which further contributes to a simple and reliable construction.

According to an embodiment, each cam follower includes a roller arranged to roll on the cam means.

The rolling contact thereby established reduces friction and provides a smooth actuation.

According to an embodiment, each cam follower includes a piston supported by a mechanical spring.

This is a simple way of ensuring a good contact between the cam follower and the cam means and to obtain the stabilizing force at the end positions. Preferably, the spring is a compression spring.

According to an embodiment, the cam means has a cam profile with a first and second axial end defining the first and second end positions, which cam profile includes a convex portion that extends over a major portion of the cam profile.

Such an extension of the cam profile is particularly suitable for the purpose of obtaining the stable end positions. By cam profile is meant the active part of the cam means, i.e. the part that is cooperating with the at least one cam follower.

According to an embodiment, the convex portion is arc shaped.

This ensures a smooth actuation avoiding the abrupt changes in the force pattern that otherwise could occur at corners on the profile. The arc shaped convex portion can be circular. The circular portion can be composed of a plurality of circular sections of different radii. The arc shaped portion can alternatively be any other kind of curve.

According to an embodiment, the convex portion forms a varying angle with the axis, which angle has a maximum in the range of 10°-45°.

The maximum angle will occur closed to the ends of the cam profile, and is on one hand sufficiently large to create the required stabilizing force in the end positions and on the other hand sufficiently small to keep the required axial driving force for the actuation at an acceptable level. Preferably this angle is in the range of 20°-30° for obtaining a well adapted compromise between these two requirements. It is to be understood for this embodiment that outside the cam profile, i.e. outside the active part of the cam means, the cam means might form an angle that is larger than the defined range.

According to an embodiment, the cam profile is symmetrical in the axial direction.

This represents a simple design and is particularly suitable in applications where the requirements on force and velocity for the actuation movement are substantially equal in both directions.

According to an alternative embodiment, the cam profile is non-symmetrical in the axial direction.

Such a shape is advantageous if the conditions required at the two end position are different, for example different contact pressures.

According to an embodiment, the cam means consists of a separate cam unit for each cam follower, which cam unit has the shape of a plate.

Thereby the weight of the cam means can be kept relatively low in comparison with a cam means made as a common part for all cam followers with a cam profile extending entirely around the axis. A low weight is important in order to allow as rapid acceleration and retardation as possible during actuation. The separate cam units might be constituted by one single plate-shaped piece or by separate pieces attached together or to the actuating means.

According to an embodiment, the actuating unit includes a rod to which the cam means is rigidly attached.

When the actuating unit is in the form of a rod which terminates as the movable contact part, the contact surface against the stationary contact part can be relatively large allowing the apparatus to be used for high currents. The cam means can be attached to the rod by being manufactured integrally therewith in one piece. Alternatively, the cam means can be manufactured separately and then joined to the rod.

According to a second aspect, the invention relates to a use of the invented switching apparatus for closing or switching an electric current of the medium or high voltage level.

With medium voltage is understood a voltage in the range of 1-72.5 kV and by high voltage is understood a voltage above 72.5 kV.

The invented use has advantages of the same kind as the invented switching apparatus and the preferred embodiments thereof, which advantages have been described above.

The above described embodiments of the invention are specified herein. It is to be understood that further embodiments of course can be constituted by any possible combination of the embodiments above and by any possible combination of these and features mentioned in the description of examples below.

The invention will be further explained through the following detailed description of examples thereof and with reference to the accompanying drawings.

DETAILED DESCRIPTION OF THE INVENTION

Figure 1:
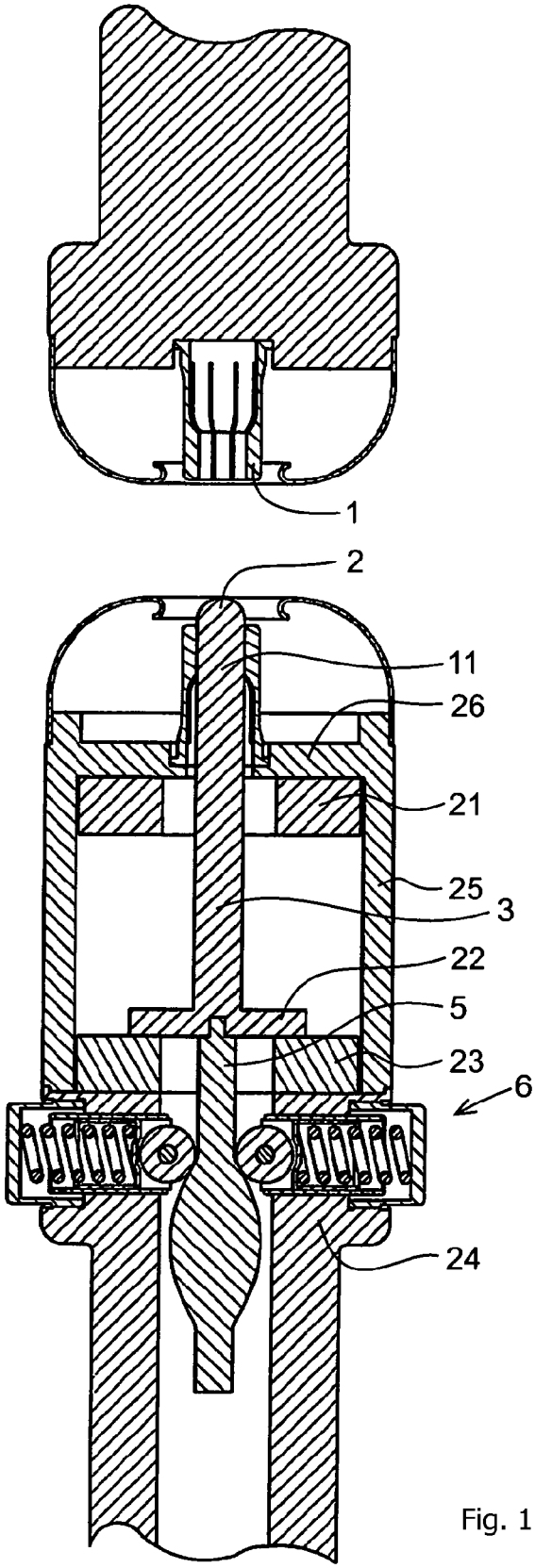
FIG. 1 is a longitudinal section through a switching apparatus according to the invention.

FIG. 1 illustrates a switching apparatus provided with a bistable mechanism according to the invention. The illustration is simplified for the sake of clarity in order to focus on the aspects that are relevant for the understanding of the invention. Thus details like the conductors and the insulation are left out. These details can be of any conventional kind and do not require to be described. The switching apparatus has a stationary contact part 1 and a movable contact part 2. The movable contact part 2 is arranged as the upper end of a first rod 3. The lower end of the rod 3 is attached to a plate 22 of conductive material. From the underside of the plate 22 a second rod 5 extends downward. The second rod 5 is arranged to cooperate with a bistable mechanism that will be described further below. In this example the first rod 3 is made integrated with the plate 22, but they might alternatively be made of separate pieces. Also the second rod 5 might alternatively be integrated with the plate 22.

The rods 3 and 5 and the plate 22 together form what in this application is called the actuating unit. In the figure the switching apparatus is in the open state. In case the switching apparatus is to be actuated to its closed state a drive mechanism forces the actuating unit 3, 5, 22 upwards, such that the movable contact part 2 enters into the stationary contact part 1, whereby the circuit will be closed. The current path thereby goes from the housing 24 to the movable contact part 2 via the upper casing 25, the flange 26 extending radially inwards therefrom, the contacting element 11 and the pin 3. The drive mechanism might be of any suitable type. In the example, the drive mechanism consists of an upper coil 21 and a lower coil 23, which coils inductively acts on the conductive plate 22 to move the actuating unit 3, 5, 22 to closed stage.

Figure 2:
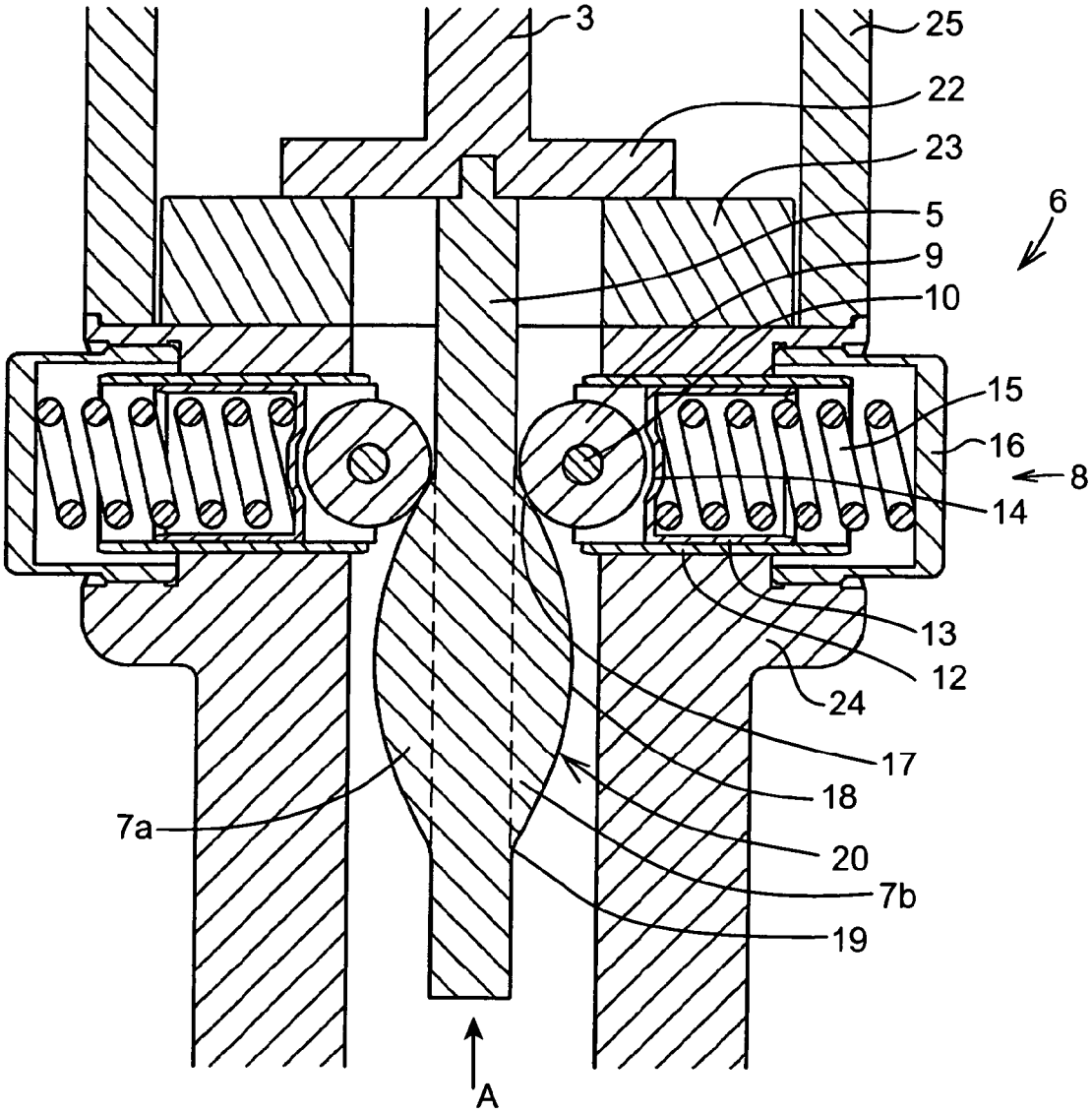
FIG. 2 is a longitudinal section illustrates a detail of FIG. 1 at an enlarged scale.

The switching apparatus is provided with a bistable mechanism 6 according to the invention. The bistable mechanism 6 is explained with reference to FIG. 2. On the rod 5 forming a part of the actuating unit there are rigidly attached two cam units 7*a*, 7*b*. Each of the cam units 7*a*, 7*b* is a plate that is radially directed in relation to the axis of the rod 5. They are located diametrically opposed to each other. In the following the description refers only to the right part of the figure and it is to be understood that the left part is equal.

The cam unit 7*b* has an outer profile 20 that is convex. It has a maximum in the middle 18, from where it symmetrically reaches the upper end point 17 and lower end point 19 of the cam profile 20. In the figure the profile has a shape composed of circular arcs of different radii, but is to be understood that other curves could be applied.

The bistable mechanism has a cam follower 8 on each side. A roller 9 of the cam follower is in contact with the profile 20 of the cam unit 7*b*. The roller 9 is arranged to be able to roll and slide on the profile 20 and is urged towards it by a spring 15. The spring 15 is a mechanical compression spring that extends in the radial direction and is seated against a support bottom 16. The spring 15 acts on the inner end wall 14 of a piston 13. The piston 13 is radially displaceable in a bushing 12 in the housing 24. The roller 9 is mounted on a pin 10 at the radially inner end of the piston 13.

In the open state as illustrated in the figure, the rod 5 is at its lowermost position. The switching apparatus is steadily kept in that position since the force from the cam follower 8 applied to the upper end 17 of the cam profile 20 creates a resistance against any upward movement of the rod 5 due to the inclination of the cam profile 20. The elements thereby cannot unintentionally move from this position.

When the switching apparatus is to be closed the coil 23 is activated and acts on the plate 22 by an inductive force to rapidly move the plate 22 upward and pull the rod 5 in the direction of arrow A. This force is dimensioned to accelerate the rod 5 sufficiently while also overcoming the force from the cam follower 8 which counteracts the movement. During the actuation movement, when the rod 5 moves upwards, the roller 9 rolls on profile 20 of the cam unit 7*b*. Thereby the spring 15 is initially compressed until the roller 9 reaches the top 18 of the profile 20. From there the spring 15 expands until the roller 9 reaches the other end 19 of the profile, at which the switching apparatus is closed. The rod 5 is kept steady in this position by the force from the cam follower 8 resisting movement of the rod in the downward direction in a similar way as in the position described above.

What is claimed is:

1. A switching apparatus for closing and/or opening an electric circuit and including an actuating unit and a bistable mechanism, the actuating unit being linearly movable between a first end position in which the switching apparatus is in a closed state and a second end position in which the switching apparatus is in an open state, which linear movement defines an axis, the bistable mechanism being arranged to ensure that the actuating unit is held in either of the end positions, which bistable mechanism includes a cam means mechanically connected to the actuating unit and at least one cam follower, characterized in that each cam follower includes a roller arranged to roll on the cam means and in that the cam means has a cam profile with a first and a second axial end defining said first and second end position, which cam profile includes an arc shaped convex portion that extends over a major portion of the cam profile, which convex portion forms a varying angle with the axis, which angle has a maximum in the range of 10° - 45°.

2. The switching apparatus according to claim 1, characterized in that the number of cam followers is one or two.

3. The switching apparatus according to claim 1, characterized in that each cam follower is arranged to be movable in a direction perpendicular to the axis.

4. The switching apparatus according to claim 3, characterized in that each cam follower is arranged to be movable in a radial direction with respect to the axis.

5. The switching apparatus according to claim 3, characterized in that there is at least two cam followers, and the cam followers are evenly distributed in the circumferential direction.

6. The switching apparatus according to claim 1, characterized in that there is at least two cam followers and that the cam followers contact the cam means in the same radial plane.

7. The switching apparatus according to claim 1, characterized in that each cam follower includes a piston supported by a mechanical spring.

8. The switching apparatus according to claim 1, characterized in that the cam profile is symmetrical in the axial direction.

9. The switching apparatus according to claim 1, characterized in that the cam profile is non-symmetrical in the axial direction.

10. The switching apparatus according to claim 1, characterized in that the cam means consists of a separate cam unit for each cam follower, which cam unit has the shape of a plate.

11. The switching apparatus according to claim 1, characterized in that the actuating unit includes a rod, to which the cam means is rigidly attached.

12. Use of a switching apparatus for closing or breaking an electric current of the medium or high voltage level, the switching apparatus including an actuating unit and a bistable mechanism, the actuating unit being linearly movable between a first end position in which the switching apparatus is in a closed state and a second end position in which the switching apparatus is in an open state, which linear movement defines an axis, the bistable mechanism being arranged to ensure that the actuating unit is held in either of the end positions, which bistable mechanism includes a cam means mechanically connected to the actuating unit and at least one cam follower, characterized in that each cam follower includes a roller arranged to roll on the cam means and in that the cam means has a cam profile with a first and a second axial end defining said first and second end position, which cam profile includes an arc shaped convex portion that extends over a major portion of the cam profile, which convex portion forms a varying angle with the axis, which angle has a maximum in the range of 10°-45°.

* * * * *